US007128824B2

(12) United States Patent
Bulan et al.

(10) Patent No.: US 7,128,824 B2
(45) Date of Patent: Oct. 31, 2006

(54) METHOD FOR ELECTROLYSIS OF AQUEOUS SOLUTIONS OF HYDROGEN CHLORIDE

(75) Inventors: Andreas Bulan, Langenfeld (DE); Walter Hansen, Leverkusen (DE); Fritz Gestermann, Leverkusen (DE); Michael Grossholz, Leverkusen (DE); Hans-Dieter Pinter, Wermelskirchen (DE)

(73) Assignee: Bayer MaterialScience AG, Leverkusen (DE)

( * ) Notice: Subject to any disclaimer, the term of this patent is extended or adjusted under 35 U.S.C. 154(b) by 5 days.

(21) Appl. No.: 10/493,484

(22) PCT Filed: Oct. 16, 2002

(86) PCT No.: PCT/EP02/11560

§ 371 (c)(1),
(2), (4) Date: Apr. 23, 2004

(87) PCT Pub. No.: WO03/035938

PCT Pub. Date: May 1, 2003

(65) Prior Publication Data

US 2004/0245117 A1 Dec. 9, 2004

(30) Foreign Application Priority Data

Oct. 23, 2001 (DE) ..... 101 52 275

(51) Int. Cl.
*C25B 1/26* (2006.01)

(52) U.S. Cl. ..... 205/620; 205/516; 205/536; 205/537

(58) Field of Classification Search ..... 205/620, 205/516, 536, 537
See application file for complete search history.

(56) References Cited

U.S. PATENT DOCUMENTS

| | | | | |
|---|---|---|---|---|
| 3,756,930 | A | 9/1973 | Weiss | |
| 4,210,501 | A * | 7/1980 | Dempsey et al. | 205/620 |
| 5,770,035 | A | 6/1998 | Fiata | |
| 6,066,248 | A | 5/2000 | Lyke | |
| 6,790,339 | B1 * | 9/2004 | Bulan et al. | 205/620 |

FOREIGN PATENT DOCUMENTS

EP 0785294 A1 7/1997

* cited by examiner

*Primary Examiner*—Arun S. Phasge
(74) *Attorney, Agent, or Firm*—Connolly Bove Lodge & Hutz LLP

(57) ABSTRACT

A method for the electrolysis of aqueous solutions of hydrogen chloride in order to produce chlorine, characterized in that the following process parameters are maintained for initial operation:

the anode half-element is filled with a 5 to 20% strength by weight hydrochloric acid, the concentration of the hydrochloric acid is more than 5% by weight during initial operation, the volumetric flow of the hydrochloric acid through the anode half-element is set in such a way that, at the start of electrolysis, the velocity of the hydrochloric acid in the anode space is from 0.05 cm/s to 0.15 cm/s, the electrolysis is started with a current density of 0.5 to 2 kA/m$^2$, and the current density is then increased continuously or discontinuously until the desired current density is reached.

7 Claims, No Drawings

METHOD FOR ELECTROLYSIS OF AQUEOUS SOLUTIONS OF HYDROGEN CHLORIDE

CROSS REFERENCE TO RELATED APPLICATIONS

This application is 35 U.S.C. 371 National Stage Application of International Application No. PCT/EP02/11560 filed Oct. 16, 2002 which claims priority to German Application No. 10152275.4 filed Oct. 23, 2001.

BACKGROUND OF THE INVENTION

The invention relates to a method for the electrolysis of aqueous solutions of hydrogen chloride in order to produce chlorine by means of gas diffusion electrode while maintaining defined operating parameters.

Aqueous solutions of hydrogen chloride, referred to below as hydrochloric acid, are formed as a waste product in many processes in which organic hydrocarbon compounds are chlorinated in oxidizing fashion with chlorine. The recovery of chlorine from these hydrochloric acids is of economic interest. The recovery can be carried out electrolytically using gas diffusion electrodes which consume oxygen in the cathode space (oxygen-consuming cathode).

A corresponding method is known from U.S. Pat. No. 5,770,035. According to that document, the electrolysis takes place in an electrolysis cell having an anode space with a suitable anode, e.g. a titanium electrode which is doped or coated with precious metal and is filled with the aqueous solution of hydrogen chloride. The chlorine formed at the anode escapes from the anode space and is fed for suitable treatment. The anode space is separated from a cathode space by a commercially available cation exchange membrane. A gas diffusion electrode is positioned on the cation exchange membrane on the cathode side. A current distributor is located behind the gas diffusion electrode. An oxygen-containing gas or pure oxygen is usually introduced into the cathode space.

The nature of the initial operation and normal operation of an electrolysis cell has an influence on the service life of the anodes or of the anode half-element and therefore on the economic viability of the method.

According to U.S. Pat. No. 5,770,035, therefore, an oxidizing agent, for example iron(III) or copper(II) is necessarily added to the solution which is to be electrolyzed in order to protect against corrosion. These additives then have to be removed again from the hydrochloric acid by means of additional outlay of apparatus. Moreover, they contaminate the hydrochloric acid and may under certain circumstances have an adverse effect on the action of the ion exchange membrane or lead to crystallization. U.S. Pat. No. 5,770,035 does not disclose any conditions for initial operation of the cell.

According to conventional methods for initial operation and normal operation, considerable corrosion to the anode coating and to the anode metal, for example titanium, beneath the coating of the anode is inevitable. The anode space, which consists of titanium, is also at risk from corrosion. Corrosion entails high operating costs, a high level of outlay on maintenance and environmental and recycling problems.

SUMMARY OF THE INVENTION

It was an object of the present invention to provide a method for the electrolysis of aqueous solutions of hydrogen chloride with optimized operating parameters.

According to the invention, the object is achieved by the features of claim 1.

DETAILED DESCRIPTION OF A PREFERRED EMBODIMENT

The subject matter of the invention is a method for the electrolysis of aqueous solutions of hydrogen chloride in order to produce chlorine, in which method the following process parameters are maintained for initial operation:

- the anode half-element is filled with a 5 to 20% strength by weight hydrochloric acid,
- the concentration of the hydrochloric acid is more than 5% by weight during initial operation,
- the volumetric flow of the hydrochloric acid through the anode half-element is set in such a way that, at the start of electrolysis, the velocity of the hydrochloric acid in the anode space is from 0.05 cm/s to 0.15 cm/s,
- the electrolysis is started with a current density of 0.5 to 2 kA/m$^2$, and the current density is then increased continuously or discontinuously until the desired current density is reached.

The optimum hydrochloric acid concentration for start-up, for initial operation and for normal operation is approximately 13% by weight. Below 5% by weight, the voltage rises, which can lead to the formation of anodic oxygen. The voltage also rises above a concentration of 20% by weight, and the corrosion increases. In this case, the anode coating may be damaged, for example, by a 25% by weight strength hydrochloric acid at 80° C. Therefore, for initial operation too, the hydrochloric acid concentration has to be at least 5% by weight. In the context of the present invention, the term initial operation is to be understood as meaning the operating time from the start of electrolysis until the desired current density is reached.

The anode used is preferably a titanium electrode which is doped or coated with precious metal. Chlorine serves to protect the anode metal and the metal which forms the anode space, e.g. titanium, from corrosion. Hydrochloric acid which has penetrated through micropores in the anode coating can attack the anode metal, for example titanium. In the event of ongoing corrosion of the anode metal, the coating may flake off. Therefore, during initial operation, when the installation is idle and when it is being filled, it should be ensured that sufficient chlorine, or at least 1 mg/l, preferably at least 50 mg/l, particularly preferably 300 mg/l, of free chlorine is present in the hydrochloric acid. In normal operation, after the desired current density has been reached, this condition is virtually always fulfilled.

After the electrolysis cell has been assembled and the anode space has been filled with hydrochloric acid, the hydrochloric acid is pumped through the anode half-element and circulated. In the process, the electrolysis cell has to be operated with a volumetric flow in the range from 0.05 cm/s to 0.15 cm/s, in order to obtain an optimum efficiency of the electrolysis. In particular, correct normal operation cannot be achieved with a lower volumetric flow. The temperature of the hydrochloric acid is in this case initially preferably between 30 and 50° C., and during normal electrolysis operation is in the range from 50 to 70° C.

According to the invention, initial operation of the electrolysis cell uses a current density of 0.5 to 2 kA/m$^2$, preferably 1 to 2 kA/m$^2$, very particularly preferably 1.5 kA/m$^2$, but a lower current density than the desired current density which is subsequently to be reached. Starting up using the desired current density ultimately causes the membrane to be destroyed, since the heat which is evolved cannot be dissipated sufficiently quickly. The desired current density should be over 1 kA/m$^2$, but preferably in the range from 2 to 8 kA/m$^2$. The precise value depends on the quantity of chlorine to be produced. A desired current density which is too low leads to insufficient chlorine gas being evolved. This can lead to the electrolyte, which is discharged from the anode space via a standpipe, to be sucked back into the anode space out of the standpipe on account of the gas pressure being too low. To avoid this, a foreign gas or chlorine would have to be added if insufficient chlorine were evolved.

The increase in the current density up to the desired current density should take place by no less than 0.5 kA/m$^2$ within 25 minutes but by no more than 1.5 kA/m$^2$ within 5 minutes. Faster start-up, i.e. a faster increase in the current density from initial operation to the desired current density can cause the electrolysis cell to overheat, which endangers the mechanical and chemical stability of the titanium. Furthermore, in the event of rapid start-up, the electrolyte can be sucked back out of the standpipe into the anode space.

The increase may in this case preferably take place discontinuously, in which case it is particularly preferable for the current density to be increased by in each case 0.5 to 1.5 kA/m$^2$, preferably by 1 kA/m$^2$, at intervals of from 5 to 25 min. Alternatively, however, the current density can also be increased continuously until the desired current density is reached.

In a preferred embodiment, the pressure difference between anode space and cathode space during initial operation until the desired current density is reached is greater than 50 mbar, then in normal operation is preferably greater than 100 mbar. This avoids additional transfer resistances and a higher electrolysis voltage, which occur if the pressure is too low, since the gas diffusion electrode has to be pressed onto the cathodic current collector by the higher pressure in the anode space. In normal operation, the anolyte is more compressible on account of its chlorine content, and the density of the anolyte decreases as a result of a rising chlorine content. Therefore, the pressure difference between anode space and cathode space in normal operation after the desired current density has been reached is preferably greater than 100 mbar.

After the desired current density has been reached, the volumetric flow of the hydrochloric acid can preferably be set in such a way that the velocity of the hydrochloric acid in the anode half-element is from 0.2 cm/s to 0.4 cm/s. This avoids siphoning-off via the standpipes and an uneven supply of liquid to the half-elements.

The method according to the invention can be optimized by the temperature difference between the inlet for the hydrochloric acid into the anode half-element (anolyte inlet) and the outlet for the hydrochloric acid from the anode half-element (anolyte outlet) being less than 15° C. This allows a uniform, low temperature distribution in the anolyte, which in particular avoids temperature peaks of over 60° C.

The method according to the invention is preferably to be used if the electrolysis cell employed is an electrolyzer in which the electrolyte and the chlorine formed are discharged from the anode half-element via a standpipe.

The electrolyzer for carrying out the method according to the invention usually comprises a plurality of electrochemical cells, in which case anode and cathode half-elements are arranged alternately. The anode half-element is formed by the anode space and the anode, and the cathode half-element is formed by the cathode space and the gas diffusion electrode as well as a current distributor. The anode and cathode half-elements are separated by a cation exchange membrane. In this case, the anode frame for forming the anode half-element, the cathode frame for forming the cathode half-element and the anode consist of stable materials, such as for example titanium alloys or titanium doped or coated with precious metal. The cation exchange membrane used can be commercially available membranes, such as for example the membrane Nafion® 324 produced by DuPont. Oxygen or an oxygen-rich gas is introduced into the cathode space. The method according to the invention can be carried out using commercially available gas diffusion electrodes, e.g. produced by E-TEK (USA), with 30% of platinum on Vulcan® XC-72 (activated carbon), with a precious metal coating on the electrode of 1.2 mg of Pt/cm$^2$. The gas diffusion electrode is pressed onto the current distributor by the cation exchange membrane, as described in EP-A 785 294, on account of a higher pressure in the anode space than the cathode space. This produces sufficient electrical contact.

EXAMPLES

The examples described below were carried out using an electrolysis cell comprising an anode half-cell and a cathode half-cell. The anode used consisted of expanded titanium metal which had been activated with a ruthenium oxide layer. A cation exchange membrane produced by DuPont, type Nafion® 324, was used to separate the anode space and the cathode space. The cathode used was a carbon-based gas diffusion electrode with a precious metal coating produced by E-TEK (USA). The gas diffusion electrode was connected to a current collector. The current collector likewise consisted of activated titanium expanded metal.

Example 1

(Hydrochloric Acid with Chlorine; in Terms of the HCl Concentration, Serves as a Comparison for Example 2, and in Terms of the Chlorine Content Serves as a Comparison for Comparative Example 1 and Example 3)

The electrolysis cell was filled with 9% strength by weight hydrochloric acid which contained 780 mg/l of free chlorine. Then, the supply of oxygen to the cathode half-element was opened and the oxygen was supplied at a volumetric flow of 1.25 m$^3$/h.

The volumetric flow of the hydrochloric acid was set in such a way that the velocity of the hydrochloric acid at the start of electrolysis was 0.1 cm/s. At the start of electrolysis, the current density was 1 kA/m$^2$, and this current density was increased by in each case 1 kA/m$^3$ at intervals of 15 minutes until the desired value for the current density (desired current density) of 4 kA/m$^3$ had been reached. After the desired current density had been reached, the volumetric flow of the hydrochloric acid was increased in such a way that its velocity was 0.3 cm/s. During initial operation, the hydrochloric acid concentration did not at any time drop below 5% by weight. During normal operation of the electrolysis cell, the hydrochloric acid concentration of 9% by weight was maintained as a result of fresh concentrated hydrochloric acid (32% strength by weight) being supplied continuously while dilute hydrochloric acid and chlorine were discharged continuously. The temperature of the hydrochloric acid was 40° C. at the start (at 1 kA/m$^2$) and was increased to 60° C. When 3 kA/m$^2$ was reached, the anolyte feed no longer had to be heated, since the anolyte outlet temperature was approximately 60° C. At over 3 kA/m$^3$, the anolyte feed was cooled, in order to ensure that the temperature of the anolyte discharge did not rise above 60° C. The temperature difference between the inlet and outlet for the hydrochloric acid was at all times less than 15° C. The electrolysis voltage was 1.5 V at a desired current density of 4 kA/m$^2$. At the end of the test, no traces of corrosion could be observed at the anode and anode half-element.

Comparative Example 1

(Hydrochloric Acid without Chlorine; Corrosion)

The electrolysis cell was filled with 13% strength by weight hydrochloric acid which did not contain any chlorine. Then, the oxygen supplied to the cathode half-element was opened and the oxygen was supplied with a volumetric flow of 1.25 m$^3$/h. The volumetric flow of the hydrochloric acid was set in such a way that the hydrochloric acid velocity at the start of electrolysis was 0.1 cm/s. At the start of electrolysis, the current density was 1 kA/m$^2$, and this current density was increased by in each case 1 kA/m$^2$ at intervals of 15 minutes until the desired value for the current density (desired current density) of 4 kA/m$^2$ was reached. After the desired current density had been reached, the volumetric flow of the hydrochloric acid was increased in such a way that the velocity was 0.3 cm/s. During initial operation, the concentration of the hydrochloric acid did not at any point drop below 5% by weight. During normal operation of the electrolysis cell, the hydrochloric acid concentration of 13% by weight was maintained by fresh concentrated hydrochloric acid (32% strength by weight) being supplied continuously while dilute hydrochloric acid and chlorine were discharged continuously. The temperature of the hydrochloric acid was initially 40° C. (at 1 kA/m$^2$) and was increased to 60° C. The temperature difference between the inlet and outlet for the hydrochloric acid was at all times less than 15° C. The electrolysis voltage when the desired current density was reached was 1.43 V. At the end of the test, it was possible to observe traces of corrosion at anode and anode half-element.

Example 2

(Influence of the HCl Concentration on Voltage when the Desired Current Density is Reached; a Voltage Minimum Lies at 13% by Weight)

The electrolysis cell was filled with 17% strength hydrochloric acid which contained 1280 mg/l of free chlorine. Then, the oxygen supply to the cathode half-element was opened and the oxygen was supplied at a volumetric flow of 1.25 m$^3$/h. The volumetric flow of the hydrochloric acid was set in such a way that the velocity of the hydrochloric acid at the start of electrolysis was 0.1 cm/s. At the start of electrolysis, the current density was 1 kA/m$^2$ and this density was increased by in each case 1 kA/m$^2$ at intervals of 15 minutes until the desired value for the current density (desired current density) of 4 kA/m$^2$ was reached. After the desired current density had been reached, the volumetric flow of the hydrochloric acid was increased in such a way that its velocity was 0.3 cm/s. During initial operation, the concentration of the hydrochloric acid did not drop below 5% by weight at any time. During normal operation of the electrolysis cell, the hydrochloric acid concentration of 17% by weight was maintained by fresh concentrated hydrochloric acid (32% by weight) being supplied continuously while dilute hydrochloric acid and chlorine were discharged continuously. The temperature of the hydrochloric acid was initially 40° C. (at 1 kA/m$^2$) and was increased to 60° C. The electrolysis voltage was 1.47 V at a desired current density of 4 kA/m$^2$. At the end of the test, no traces of corrosion could be observed at the anode and anode half-element.

Example 3

(Hydrochloric Acid with Chlorine Content; No Corrosion)

The procedure was as in Comparative Example 1, except that the hydrochloric acid was additionally mixed with chlorine. The electrolysis cell was filled with 13% strength by weight hydrochloric acid which contained 200 mg/l of free chlorine.

Then, the oxygen supply to the cathode half-element was opened and the oxygen was supplied at a volumetric flow of 1.25 m$^3$/h. The volumetric flow of the hydrochloric acid was set in such a way that the velocity of the hydrochloric acid at the start of electrolysis was 0.1 cm/s. At the start of electrolysis, the current density was 1 kA/m$^2$, and this density was increased by in each case 1 kA/m$^2$ at intervals of 15 minutes until the desired value for the current density (desired current density) of 4 kA/m$^2$ had been reached. After the desired current density had been reached, the volumetric flow of the hydrochloric acid was increased in such a way that the velocity was 0.3 cm/s. During initial operation, the concentration of the hydrochloric acid did not drop below 5% by weight at any time. During normal operation of the electrolysis cell, the hydrochloric acid concentration of 13% by weight was maintained by fresh concentrated hydrochloric acid (32% strength by weight) being supplied continuously while dilute hydrochloric acid and chlorine were discharged continuously. The temperature of the hydrochloric acid was initially 40° C. (at 1 kA/m$^2$) and was increased to 60° C. The temperature difference between inlet and outlet for the hydrochloric acid was less than 15° C. at any time. The electrolysis voltage was 1.43 V at a desired current density of 4 kA/m$^2$. No traces of corrosion in the anode half-element were observed even after an operating time of 2400 h.

Example 4

(Influence of the Hydrochloric Acid Flow Velocity)

The electrolysis cell was filled with 13% strength by weight hydrochloric acid which contained 200 mg/l of free chlorine. Then, the oxygen supply to the cathode half-element was opened and the oxygen was supplied at a volumetric flow of 1.25 m$^3$/h. The volumetric flow of the hydrochloric acid was set in such a way that the velocity of the hydrochloric acid at the start of electrolysis was 0.2 cm/s. The temperature of the hydrochloric acid was set to 40° C. Initial operation could not commence, since strong pressure pulses were formed, which led to safety cut-outs. The safety cut-out is intended to prevent damage in particular to the cation exchange membrane and the gas diffusion electrode and also to the electrolysis half-elements as a whole. It was only possible to start electrolysis when the flow velocity was reduced to 0.14 cm/s.

The current density was 1 kA/$m^2$ at the start of electrolysis and was increased by in each case 1 kA/$m^2$ at intervals of 15 minutes until the desired value for the current density (desired current density) of 4 kA/$m^2$ was reached. After the desired current density had been reached, the flow velocity for long-term operation was increased to 0.3 cm/s. During initial operation, the hydrochloric acid concentration did not drop below 5% by weight at any time. During normal operation of the electrolysis cell, the hydrochloric acid concentration of 13% by weight was maintained by fresh concentrated hydrochloric acid (32% strength by weight) being supplied continuously while dilute hydrochloric acid and chlorine were discharged continuously. The temperature of the hydrochloric acid was increased from initially 40° C. (at 1 kA/$m^2$) to 60° C. The temperature difference between inlet and outlet for the hydrochloric acid was less than 15° C. at all times. The electrolysis voltage was 1.43 V at the desired current density.

The invention claimed is:

1. A method for the electrolysis of aqueous solutions of hydrogen chloride in order to produce chlorine, wherein the following process parameters are maintained for initial operation:

the anode half-element is filled with a 5 to 20% strength by weight hydrochloric acid that contains at least 1 mg/l of free chlorine, the concentration of the hydrochloric acid is at least 5% by weight during initial operation, the volumetric flow of the hydrochloric acid through the anode half-element is set in such a way that, at the start of electrolysis, the velocity of the hydrochloric acid in the anode space is from 0.05 cm/s to 0.15 cm/s, the electrolysis is started with a current density of 0.5 to 2 kA/$m^2$, and the current density is then increased continuously or discontinuously until the desired current density is reached.

2. The method as claimed in claim 1, wherein, during normal operation, the concentration of the hydrochloric acid in the anode half-element is set in the range from 5 to 20% by weight.

3. The method as claimed in claim 1, wherein the current density is increased by in each case 0.5 to 1.5 kA/$m^2$ at intervals of from 5 to 25 min.

4. The method as claimed in claim 1, wherein, after the desired current density has been reached, the volumetric flow of the hydrochloric acid is set in such a way that the flow velocity of the hydrochloric acid in the anode half-element is from 0.2 cm/s to 0.4 cm/s.

5. The method as claimed in claim 1, wherein the desired current density is greater than 1 kA/$m^2$.

6. The method as claimed in claim 1, wherein the pressure difference between anode space and cathode space during initial operation until the desired current density is reached is greater than 50 mbar.

7. The method as claimed in claim 1, wherein the pressure difference between anode space and cathode space after the desired current density has been reached is greater than 100 mbar.

* * * * *